US005662430A

United States Patent [19]

Lee

[11] Patent Number: 5,662,430

[45] Date of Patent: Sep. 2, 1997

[54] UNIVERSAL GROUND MARKER

[76] Inventor: Fang Ming Lee, 11 E. California St., Arcadia, Calif. 91006

[21] Appl. No.: 548,749

[22] Filed: Oct. 26, 1995

[51] Int. Cl.[6] ..... E01F 9/06

[52] U.S. Cl. ..... 404/15; 404/16

[58] Field of Search ..... 404/9, 13, 14, 404/15, 16

[56] References Cited

U.S. PATENT DOCUMENTS

| | | | |
|---|---|---|---|
| Re. 16,131 | 8/1925 | Cretney . | |
| 1,661,242 | 3/1928 | Truxal . | |
| 1,708,369 | 4/1929 | Nater . | |
| 1,878,691 | 9/1932 | Foster . | |
| 2,434,103 | 1/1948 | Elliott . | |
| 2,635,513 | 4/1953 | Batterson . | |
| 2,664,065 | 12/1953 | Thompson . | |
| 2,699,982 | 1/1955 | Batterson . | |
| 3,096,694 | 7/1963 | Lynn . | |
| 3,392,639 | 7/1968 | Heenan . | |
| 3,575,092 | 4/1971 | Freeman | 404/14 X |
| 3,901,583 | 8/1975 | Schaefer . | |
| 4,618,281 | 10/1986 | Ajemian | 404/16 |
| 5,069,577 | 12/1991 | Murphy | 404/13 X |
| 5,104,256 | 4/1992 | D'Avela . | |
| 5,354,143 | 10/1994 | Lindner . | |
| 5,425,596 | 6/1995 | Steere et al. | 404/14 |
| 5,449,244 | 9/1995 | Sandino | 404/14 |

*Primary Examiner*—James Lisehora
*Attorney, Agent, or Firm*—Ladas & Parry

[57] ABSTRACT

The invention is a ground marker that is durable and yet can be manufactured with ease and without great expense. The ground marker has a shell portion bonded to a support structure. A lip formed around the periphery of the support structure against which the shell rests maintains the shell in a secure position. The support structure has support posts that serve to buttress the shell which bears the weight of vehicles traveling thereon. Filler material disposed between the shell and support structure serves to provide further support. A coating of protectant, preferably ceramic, provides reflectivity and protection against the elements.

30 Claims, 4 Drawing Sheets

FIG. 3
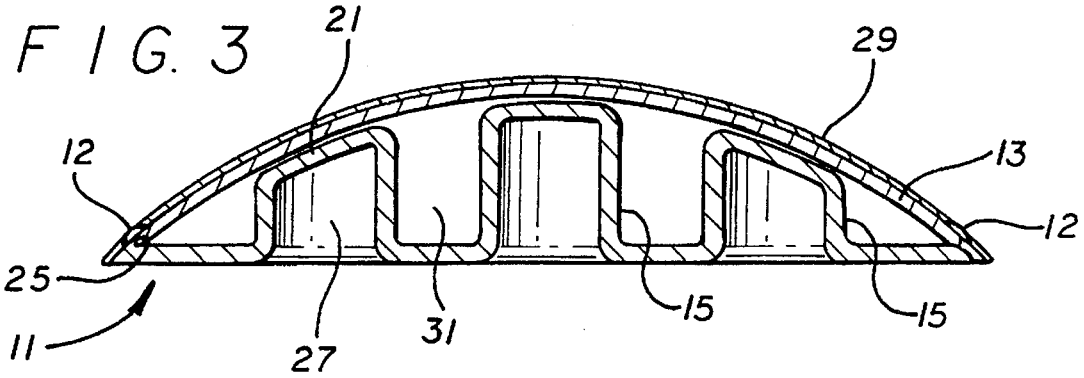
FIG. 5
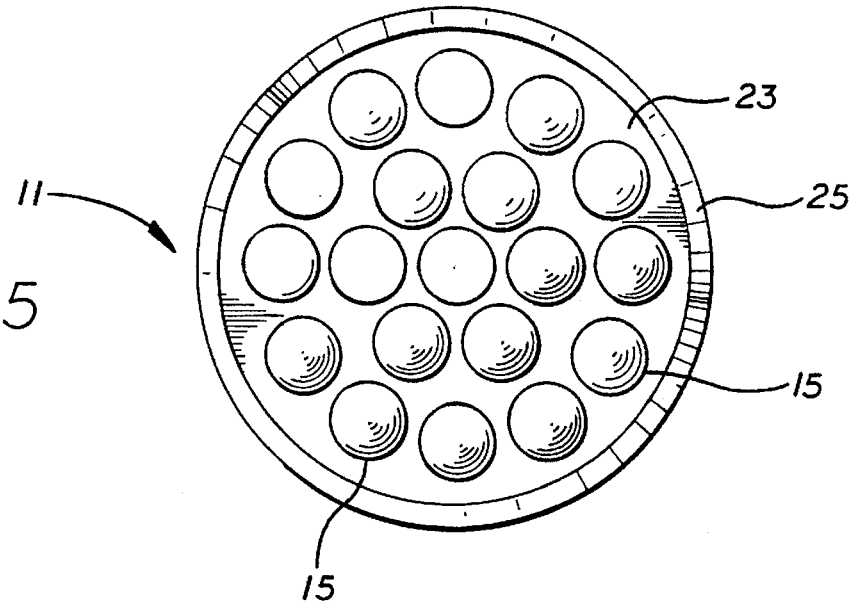
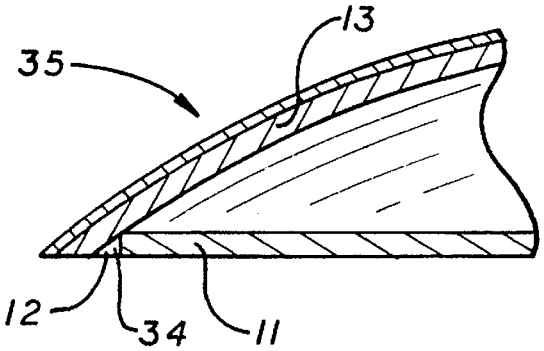
FIG. 6

UNIVERSAL GROUND MARKER

FIELD OF THE INVENTION

The present invention pertains to ground markers for marking and delineating lanes and travel areas for vehicle, airline and other traffic, and more particularly, for a new, durable and inexpensive marker and a method of making the same.

BACKGROUND OF THE INVENTION

Ground markers are a ubiquitous article in everyday life. Little noticed and taken for granted, ground markers can be found everywhere, on public streets, freeways, shopping center parking lots and airport runways, to name several such places. The number of ground markers in use and their cumulative cost is staggering to imagine.

The art of ground marker production has been the subject of a number of patents, among them U.S. Pat. Nos. 2,699,982; Re. 16,131; 1,708,369; 1,878,691; 5,104,256; 1,661,242; 3,392,639; 3,901,583; and 5,354,143. The improvements to ground markers are often addressed to three different features: visibility, durability and cost of manufacture.

The purpose of a ground marker is to mark or delineate traffic lanes or otherwise control and influence traffic movement. To serve this purpose, a ground marker must be highly visible. Visibility can be enhanced by the use of a reflective coating on the marker, or by the use of retro-reflectors, a device that reflects light back to its source. U.S. Pat. No. 5,104,256 teaches a low profile pavement marker that has a smooth upper reflective surface which scatters overhead light in all directions for daytime visibility, and a retro-reflective strip (to reflect light in the direction of its source) for night-time visibility.

A ground marker must also be durable to endure the natural elements and the constant wear and tear wrought by the friction of vehicle wheels. U.S. Pat. No. 3,392,639 teaches utilizing a shell of synthetic resin that is filled with material to form a solid core. The core reinforces the shell to provide a solid structure which initially is capable of withstanding forces applied to the outer surface of the marker. However, the resin itself is subject to wear and tear and the constant forces and vibrations exerted on the surface of the marker may eventually cause the inner resin core to crack or shatter, thereby weakening the entire structure. U.S. Pat. No. 5,104,256 suggests the use of ceramic in the manufacture of ground markers because of its long life and maintenance of reflective qualities and because the ceramic construction eliminates rust and corrosion. However ceramic is expensive compared to other materials such as plastic, metal, metallic/plastic compositions and alloys.

Durability can also be enhanced by the use of supports such as those used in U.S. Pat. No. 5,354,143. The ground marker of this patent includes a base block with radially aligned ribs. A cap structure is applied to the base block in situ. The ribs are supposed to aid in preventing cracking of the base block.

Given the great number of ground markers that are in use, the cost of manufacture becomes a major factor. A savings as small as a cent per unit ground marker can result in substantial savings for both the manufacturer and the purchaser when the large quantities of ground markers are taken into consideration. As indicated earlier, ceramic material offers durability, ease of maintenance, reflectivity and resistance to rust and corrosion. Plastic is cheaper but is less durable and is prone to breakage. Metal is subject to rust and corrosion and is malleable under certain conditions.

SUMMARY OF THE INVENTION

An object of this invention is to provide a ground marker that not only is highly visible and durable, but is also easy and economical to manufacture. The marker of the present invention is preferably constructed from metal which is more durable than plastic or resin, which have a tendency to crack or break under conditions of high stress. The possibility of breakage or cracking increases with the size of the ground marker. Made of metal, the components of the ground marker of this invention can be formed by molding or by stamping to thereby reduce or minimize the cost of manufacture. The ground marker of the invention maintains its visibility and durability by the application of a layer of protective coating on the surface exposed during use. Among the possible protective coatings are paint, resin, and ceramic. Although ceramic is expensive, it is preferred to other materials, and the use of a protective layer of ceramic material as opposed to constructing the ground marker entirely from ceramic results in a substantial cost savings. The layer of ceramic protects the ground marker from wear and tear in use and from rust and corrosion, while providing a high level of reflectivity which is an important requirement of ground markers.

BRIEF DESCRIPTION OF THE DRAWINGS

In describing the invention, reference will be made to the accompanying drawings wherein:

FIG. 3 is a cross-sectional view of the preferred embodiment through line 3—3 of FIG. 2.

FIG. 5 is a view of an alternative support structure of the invention.

FIG. 6 is a view of an alternate coupling structure between the shell and the support structure.

DETAILED DESCRIPTION

The pavement marker described herein is generally round and of low profile, and has a flattened hemispherical construction. However those skilled in the art will appreciate that pavement markers can take various configurations, shapes and sizes. The invention can be adapted accordingly.

Figure 1:
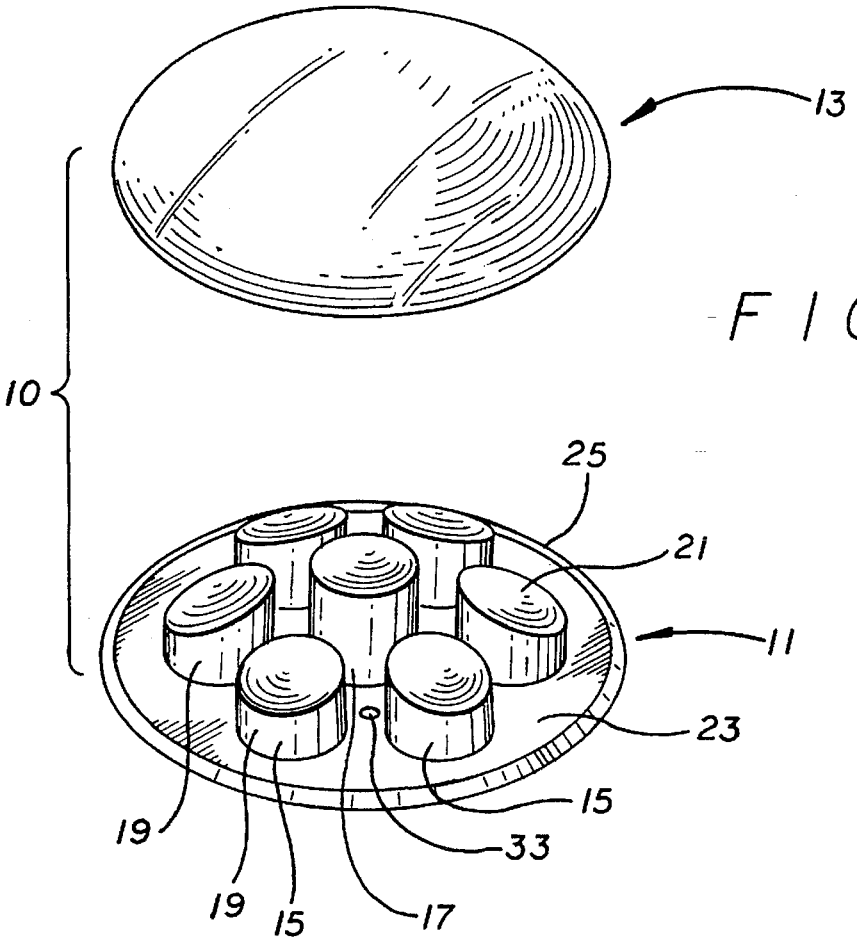
FIG. 1 is a perspective view of the preferred embodiment of the invention showing the shell and support structure prior to their bonding together.
Figure 2:
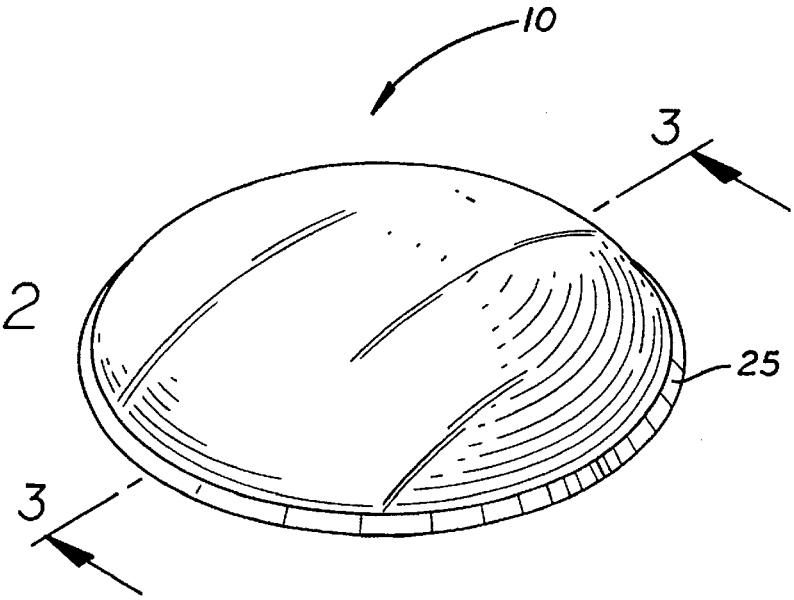
FIG. 2 is a perspective view of the preferred embodiment after the shell and support structure have been coupled together.
Figure 3A:
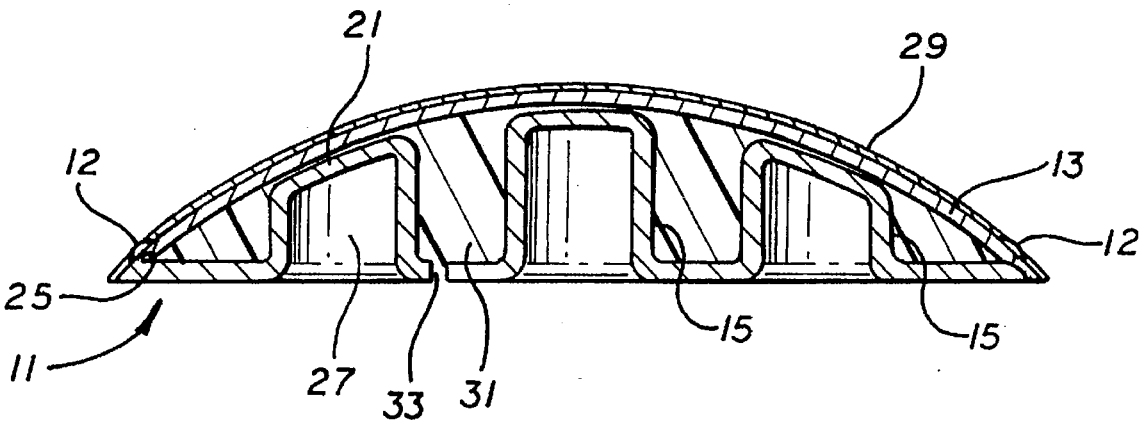
FIG. 3A is a cross-sectional view of the preferred embodiment with filling.
Figure 4:
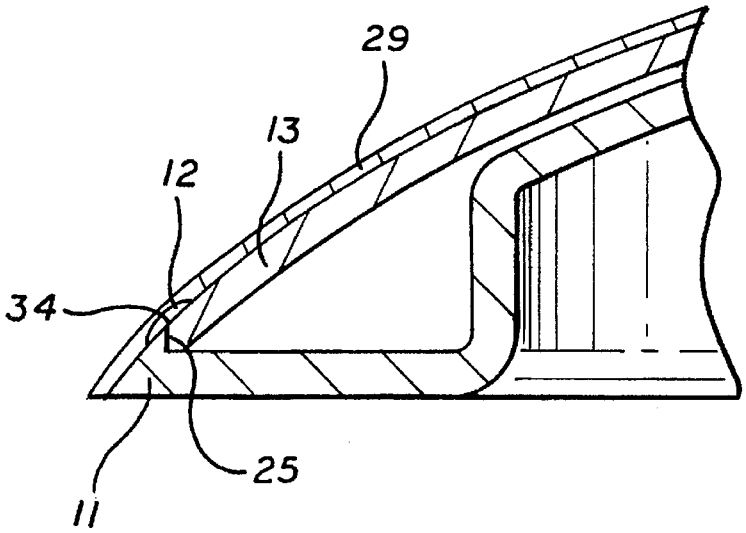
FIG. 4 is a enlarged view of a portion of the preferred embodiment showing the coupling of the support structure and the shell.

Referring to the drawings, there is illustrated in FIGS. 1, 2, and 3, an embodiment 10 of the preferred ground marker of this invention. The ground marker is comprised of a support structure 11 which is preferably coupled and bonded 12 to a shell 13. FIG. 1 provides a perspective view of these two components.

The support structure 11 has a plurality of support posts 15. In the preferred embodiment 10, the support posts 15 comprise a central support 17 and a number of outer supports 19 that are preferably arranged symmetrically around the central support 17. As can be seen in FIG. 1, the top plateau portion 21 of each support post 15 is tapered to conform to the inner curvature and height of the shell 13. The purpose of the support posts 15 is to provide buttressing support for the shell 13 which is exposed to constant, pounding downward forces exerted by vehicles traveling thereon. The support structure 11 has a flat base portion 23 and peripheral lip 25 at the support structure's outer perimeter. The support structure 11 is provided with a flat base portion 23 so that the ground marker 10 can be positioned on and bonded to a ground surface. The bonding to the ground surface can be achieved by the use of any suitable bonding agent. The openings 27, more clearly seen in FIG. 3, provided at the base of the support posts 15 enable a bonding agent to secure the ground marker 10 more effectively to the ground.

The shell 13 may be attached to the support structure 11 by any conventional bonding method. Welding is one such method and is the preferred method. A strong adhesive may also be used to cement the shell 13 to support structure 11. The lip 25 located on the perimeter of the support structure 11 serves two purposes: First it provides a structure onto which the shell 13 may be fitted. Second the lip 25 acts to provide additional support for the shell 13 to resist outward forces caused by the weight of vehicles traveling over the ground marker 10. Without the support of the lip 25, the constant lateral forces tend to cause the shell 13 to separate from the support structure 11.

FIG. 3 is a cross-sectional view of the invention through line 3—3 of FIG. 2. As can be clearly seen, shell 13 is seated firmly against lip 25 of support structure 11. A protective coating 29 has been applied to the outer surface of shell 13. The coating 29 is preferably of ceramic composition. Ceramic has been found to be high in durability and is excellent in eliminating rust and corrosion. Additionally, ceramic is reflective and maintains its reflectivity through time and harsh conditions. The major drawback of ceramic is that it is expensive. Another drawback of ceramic is that it is prone to cracking or fracturing apart when used in larger blocks. By producing a ground marker out of metal and coating it with ceramic, much of the expense of ceramic may be minimized, as well as its tendency to fracture. The protective coating can also be made from plastic, glass, polymer plastics, Teflon (a trademark of DuPont Corp.), or other suitable material however. Teflon is also useful because it is chemical-resistant and moisture-resistant.

The marker of the preferred embodiment of this invention can be easily and inexpensively manufactured. The shell 13 and the support structure 11, both preferably made of metal, can be formed either by molding or by stamping. The shell 13 and support structure 11 are then coupled and preferably welded 34 together.

To provide additional support for the ground marker, filling 31 can be injected through an opening 33. This is best viewed in FIG. 3A. The filling may be thermoplastic material, polymer plastic material, organic resinous, or anyone of the materials known in the art, that is fluid in form when injected into the marker and hardens into a solid state with cooling or the passing of time. The filling 31 fills the space between the support structure 11 and the shell 13. When hardened, the filling 31 provides a solid mass that provides additional support for the shell 13 against the weight of vehicles. The support posts 15 in the filling 31 enable the filling 31 to resist cracking and breakage.

The dimensions of the marker of the present invention may vary. For highway use, the diameter of the support structure 11 may range from 10–15 cm and the thickness of the ground marker, i.e. the distance from the flat base portion 23 to the part of the shell 13 directly opposite thereof may be 1 to 3 cm. Ground markers for airport use may be somewhat larger for increased visibility.

The number and arrangement of the support posts 15 may also vary, depending on the size of the ground marker and the circumstances under which the ground marker may be used. FIG. 5 illustrates an alternative arrangement of support posts 15.

FIG. 6 illustrates another manner of coupling the support structure 11 with the shell 13. Here the shell 13 is fitted over the periphery of the support structure 11 and the two components are then bonded 12 together, preferably by welding 34, near the point of contact. The support structure 11 lacks the lips 25 as described earlier and therefore the resulting ground marker 35 is not quite as structurally sound as the preferred embodiment 10 of the invention. Nevertheless, ground marker 35 is durable, inexpensive to produce, highly utilitarian in view of the prior art, especially if welded.

Figure 7:
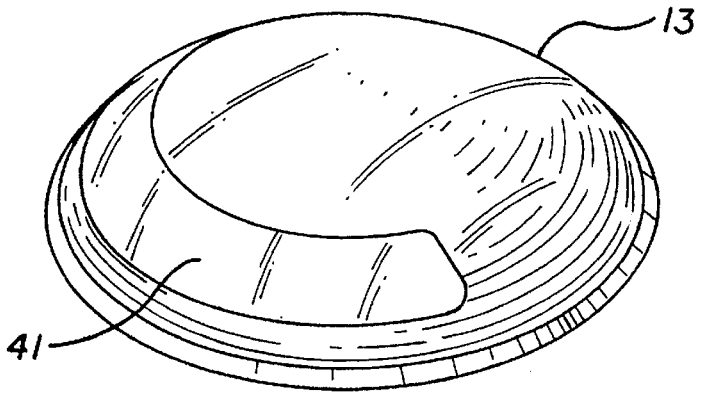
FIG. 7 illustrate an alternative shell having a retro-reflective device mounted thereon.

A retro-reflecting device 41 (see FIG. 7) can also be fitted onto the shell 13 for those situations when it is desirable for light to be reflected back to its source. This can be seen in FIG. 6.

Figure 8:
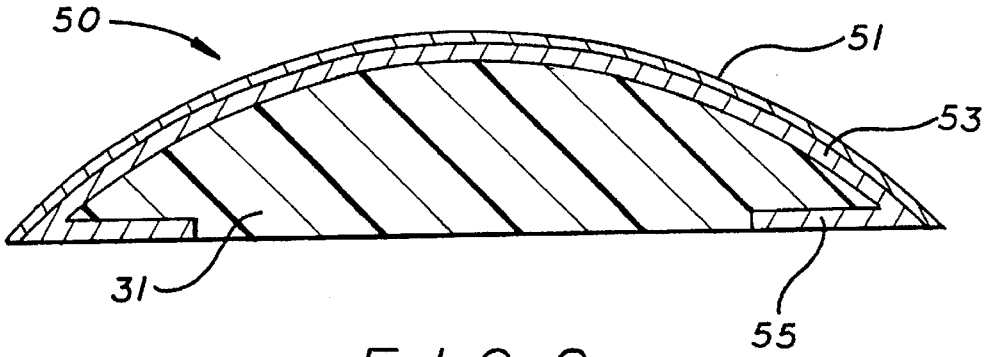
FIG. 8 illustrates a further embodiment of the invention.

In a further embodiment of the invention (see FIG. 8), the ground marker 50 may comprised a shell 53 with partial base 55. Shell 53 constitutes a one-piece enclosure into which filling 31 may be injected either in situ or at an alternative site of manufacture. Protective coating 51, again preferably of ceramic material, is applied to the exposed exterior portions of shell 53 to provide reflectivity and to protect the metal shell 53 against rust and corrosion. This ground marker 50 is simple and inexpensive to produce and yet is durable enough to withstand the elements.

Figure 9:
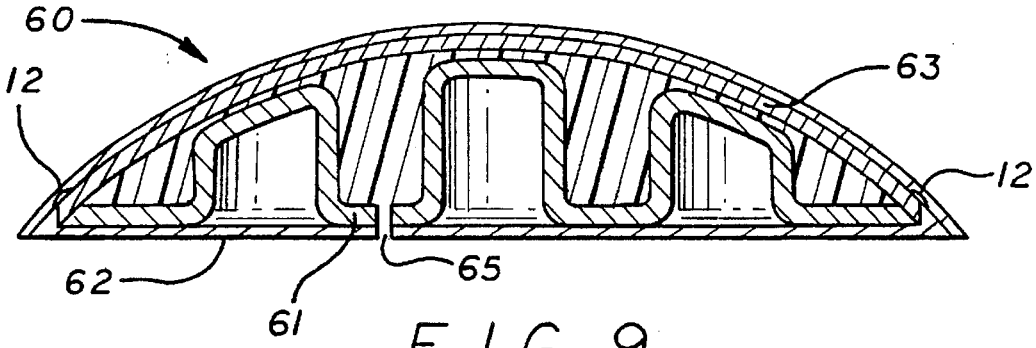
FIG. 9 illustrates a further embodiment of the invention.

In another embodiment of the invention 60, depicted in FIG. 9, a flat base 62 is coupled with the shell 63 with a separate support structure 61 contained within the chamber formed by the coupling of the shell 63 with the flat base 62. The lip 25 is formed on the flat base 62 rather than on the support structure 61 as in the previously described embodiments. Bonding 12 is applied to the area where the support structure 61 and flat base 62 couple together. If desired, filling 31 can be injected into the space between shell 63 and support structure 61 through aperture 65 which must extend through both flat base 62 and support structure 61. Embodiment 60 may be desired where a flat base is needed for the ground marker.

The drawings and the foregoing description are not intended to represent the only form of the invention in regard to the details of its construction and manner of operation. In fact, this apparatus and method can be adapted to a great many different situations. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. A ground marker comprising:

a support structure, said support structure having an outer perimeter, a retaining lip disposed along said perimeter, a base portion, and a plurality of support posts which project from said base portion;

a shell portion of generally concave construction, said shell portion having an outer periphery and an inner concave surface, said outer periphery fitting within and contiguous to said retaining lip, said shell portion given structural support by said retaining lip;

bonding means securing said support structure to said shell portion.

2. A ground marker as claimed in claim 1 wherein said support structure and said shell portion provide a chamber formed therebetween, said chamber being filled with filler material.

3. A ground marker as claimed in claim 1 further comprising a layer of protectant on an outer surface of said shell portion.

4. A ground marker as claimed in claim 3 wherein said layer of protectant is made from ceramic material.

5. A ground marker as claimed in claim 3 wherein a retro-reflective device is disposed on said shell.

6. A ground marker as claimed in claim 1 wherein said bonding means is comprised of welding said support structure to said shell.

7. A ground marker comprising:

a support structure, said support structure having an outer perimeter, a base, and a plurality of support posts which project from said base;

a shell of generally concave construction, said shell having an outer periphery and an inner concave surface, said outer periphery coupling with said outer perimeter of said support structure, the support posts of said support structure having surfaces which conform shapewise to said inner concave surface; and bonding means securing said support structure to said shell.

8. A ground marker as claimed in claim 7 wherein said support structure and said shell provide a chamber therebetween, said chamber filled with filler material.

9. A ground marker as claimed in claim 8 further comprising a layer of protectant on an outer surface of said shell portion.

10. A ground marker as claimed in claim 9 wherein said layer of protectant is made from ceramic material.

11. A ground marker as claimed in claim 7 wherein a retro-reflective device is disposed on said shell.

12. A method of making a road marker, said method comprising:

forming a support structure with an outer perimeter, a retaining lip arranged along said perimeter, a base, and a plurality of support posts projecting from said base;

providing a shell portion having an outer periphery and an inner concave surface, said outer periphery fitting within and adjacent to said retaining lip;

bonding said support structure to said shell portion.

13. A method of making a ground marker as claimed in claim 12 wherein said support structure has an aperture disposed thereon and further comprising the step of injecting filler material into the ground marker through said aperture.

14. A method of making a ground marker as claimed in claim 12 wherein said bonding step is comprised of welding said outer perimeter of said support structure to said outer periphery of said shell portion.

15. A method of making a ground marker as claimed in claim 12 further comprising the step of covering said shell with a layer of protectant material.

16. A method of making a ground marker as claimed in claim 15 wherein said protectant layer is ceramic.

17. A ground marker comprising:

a support structure, said support structure having a base portion, and a plurality of support posts which project from said base portion;

a flat base having an outer perimeter and a retaining lip arranged along said perimeter;

a shell portion having an outer periphery and an inner concave surface, said outer periphery fitting within said retaining lip with said support structure disposed within the space between said shell and said flat base;

bonding means securing said flat base to said shell portion.

18. A ground marker as claimed in claim 17 wherein said support structure and said shell portion provide a chamber formed therebetween, said chamber being filled with filler material.

19. A ground marker as claimed in claim 17 further comprising a layer of protectant on an outer surface of said shell portion.

20. A ground marker as claimed in claim 19 wherein said layer of protectant is made from ceramic material.

21. A ground marker as claimed in claim 19 wherein a retro-reflective device is disposed on said shell.

22. A ground marker as claimed in claim 17 wherein said bonding means is comprised of welding said flat base to said shell portion.

23. A ground marker comprising:

a support structure, said support structure having an outer perimeter, a retaining lip formed at said perimeter, a base portion, and a plurality of support posts which project from said base portion;

a shell portion of generally concave construction, said shell portion having an outer periphery and an inner concave surface, said outer periphery being disposed adjacent said retaining lip, said support posts having upper plateau portions, said upper plateau portions conforming shapewise to said inner concave surface;

bonding means securing said support structure to said shell portion.

24. A ground marker as claimed in claim 23 wherein said support structure and said shell portion provide a chamber formed therebetween, said chamber being filled with filler material.

25. A ground marker as claimed in claim 24 further comprising a layer of protectant on an outer surface of said shell portion.

26. A ground marker as claimed in claim 25 wherein said layer of protectant is made from ceramic material.

27. A ground marker as claimed in claim 26 wherein said bonding means is comprised of welding said support structure to said shell.

28. A ground marker comprising:

a support structure, said support structure having an outer perimeter, a retaining lip formed along said perimeter, a base portion, and a plurality of support posts which project from said base portion;

a shell portion of generally concave construction, said shell portion having an outer periphery and an inner concave surface, said outer periphery fitting within and contiguous to said retaining lip, wherein said support posts have upper plateau portions, said upper plateau portions conforming shapewise to said inner concave surface;

bonding means securing said support structure to said shell portion.

29. A ground marker comprising:

a support structure, said support structure having a base portion, and a plurality of support posts which project from said base portion;

a flat base having an outer perimeter and a retaining lip along said perimeter;

a shell portion of generally concave construction, said shell portion having an outer periphery and an inner concave surface, said outer periphery fitting within and contiguous to said retaining lip with said support structure disposed within the space between said shell and said flat base, wherein said support posts have upper plateau portions, said upper plateau portions conforming shapewise to said inner concave surface;

bonding means securing said outer perimeter of said support structure to said outer periphery of said shell portion.

30. A marker comprising: first and second elements, said first element having at least a first surface with a generally curved configuration, said second element having a retaining lip arranged to confront a peripheral edge of said first element, at least one of said first and second elements having at least one projection, said first and second elements being fixedly attached to each other in a confronting relationship with said retaining lip of the second element confronting the peripheral edge of the first element and with said at least one projection confronting an interior surface of the other of said first and second elements thereby providing structural support in the event of deformation of said first surface.

* * * * *